US010865783B2

(12) United States Patent
Lee et al.

(10) Patent No.: US 10,865,783 B2
(45) Date of Patent: Dec. 15, 2020

(54) LINEAR COMPRESSOR

(71) Applicant: LG Electronics Inc., Seoul (KR)

(72) Inventors: Kyungmin Lee, Seoul (KR); Kiwon Noh, Seoul (KR)

(73) Assignee: LG Electronics Inc., Seoul (KR)

( * ) Notice: Subject to any disclaimer, the term of this patent is extended or adjusted under 35 U.S.C. 154(b) by 324 days.

(21) Appl. No.: 15/865,957

(22) Filed: Jan. 9, 2018

(65) Prior Publication Data

US 2018/0195504 A1 Jul. 12, 2018

(30) Foreign Application Priority Data

Jan. 12, 2017 (KR) ..... 10-2017-0004949

(51) Int. Cl.
*F04B 39/12* (2006.01)
*F04B 35/04* (2006.01)
(Continued)

(52) U.S. Cl.
CPC ..... *F04B 39/125* (2013.01); *F04B 17/03* (2013.01); *F04B 17/04* (2013.01); *F04B 35/04* (2013.01);
(Continued)

(58) Field of Classification Search
CPC ..... F04B 17/03; F04B 17/04; F04B 35/04; F04B 35/045; F04B 39/121; F04B 39/125; F04B 53/16
(Continued)

(56) References Cited

U.S. PATENT DOCUMENTS 4,067,667 A * 1/1978 White ..... F04B 35/045 417/416
4,353,220 A * 10/1982 Curwen ..... H02K 33/02 417/214
(Continued)

FOREIGN PATENT DOCUMENTS

CN 101205885 6/2008
CN 104251197 12/2014
(Continued)

OTHER PUBLICATIONS

Chinese Office Action in Chinese Appln. No. 201810015306.2, dated Jan. 2, 2019, 13 pages (with English translation).
(Continued)

*Primary Examiner* — Christopher S Bobish
(74) *Attorney, Agent, or Firm* — Fish & Richardson P.C.

(57) ABSTRACT

A linear compressor includes a cylinder that defines a compression space configured to receive refrigerant, a piston that is located in the cylinder and that is configured to move in an axial direction of the cylinder and to compress refrigerant in the cylinder, a discharge cover that defines a discharge space configured to receive refrigerant discharged from the compression space, a frame configured to accommodate the cylinder and coupled to the discharge cover at a front side of the frame, and a plurality of blocking members that are located between the discharge cover and at least one of the frame or the cylinder. The plurality of blocking members are configured to restrict heat transfer to at least one of the frame or the cylinder from refrigerant discharged from the compression space.

19 Claims, 8 Drawing Sheets

(51) Int. Cl.
*F04B 17/03* (2006.01)
*F04B 53/16* (2006.01)
*F04B 17/04* (2006.01)

(52) U.S. Cl.
CPC ..... *F04B 35/045* (2013.01); *F04B 39/121* (2013.01); *F04B 53/16* (2013.01)

(58) Field of Classification Search
USPC ..... 417/417
See application file for complete search history.

(56) References Cited

U.S. PATENT DOCUMENTS 4,701,114 A 10/1987 Andersen et al.
5,916,349 A 6/1999 Czabala
6,902,381 B2 * 6/2005 Hur ..... F04B 39/125 417/570
8,257,061 B2 * 9/2012 Ribas, Jr. ..... F04B 39/064 417/372
8,684,706 B2 * 4/2014 McGill ..... F04B 35/045 417/363
9,850,893 B2 * 12/2017 Ki ..... F04B 39/0027
2004/0109777 A1 6/2004 Hur et al.
2005/0008512 A1 1/2005 McGill et al.
2005/0175473 A1 * 8/2005 Park ..... F04B 39/121 417/363
2006/0091735 A1 * 5/2006 Song ..... F04B 17/04 310/12.25
2007/0020127 A1 * 1/2007 Park ..... F04B 39/125 417/415
2014/0077460 A1 * 3/2014 Mori ..... F16J 15/062 277/591
2015/0377531 A1 * 12/2015 Lee ..... F04B 53/14 62/473

FOREIGN PATENT DOCUMENTS

CN 104662296 5/2015
KR 10-1997-0001966 1/1997
WO WO9927232 6/1999
WO WO2004081378 9/2004

OTHER PUBLICATIONS

European Extended Search Report in European Application No. 18151349.0, dated May 24 2018, 9 pages.

* cited by examiner

LINEAR COMPRESSOR

CROSS-REFERENCE TO RELATED APPLICATIONS

This application claims priority under 35 U.S.C. 119 and 35 U.S.C. 365 to Korean Patent Application No. 10-2017-0004949, filed on Jan. 12, 2017, in Korea, the entire contents of which are hereby incorporated by reference in its entirety.

FIELD

The present disclosure relates to a linear compressor.

BACKGROUND

A cooling system may circulate refrigerant to generate cold air. For example, a cooling system may repeatedly perform a compression process, a condensation process, an expansion process, and an evaporation process of the refrigerant. In some examples, the cooling system may include a compressor, a condenser, an expansion device and an evaporator. The cooling system may be installed in a home appliance such as a refrigerator, an air conditioner, or the like.

A compressor may receive power from a power generating device such as an electric motor and a turbine to increase pressure by compressing air, refrigerant, or various other working gases. Compressors have been widely used in home appliances or in the industry.

A compressor may be roughly classified into a reciprocating compressor, a rotary compressor, and a scroll compressor based on a compression space through which a working gas is suctioned or discharged. For example, a compression space in a reciprocating compressor is defined between a piston and a cylinder so that the piston linearly reciprocates inside the cylinder to compress a refrigerant. A compression space in a rotary compressor is defined between an eccentrically rotated roller and a cylinder so that the roller is eccentrically rotated along an inner wall of the cylinder to compress a refrigerant. A compression space in a scroll compressor is defined between an orbiting scroll and a fixed scroll so that the orbiting scroll is rotated along the fixed scroll to compress a refrigerant.

In recent years, a linear compressor, which can be classified as a reciprocating compressor, has been developed in which a piston is directly connected to a reciprocating driving motor so that compression efficiency may be improved without mechanical loss due to movement conversion. In some examples, the linear compressor may have a simple structure.

The linear compressor may be configured to suction, compress, and then discharge refrigerant while a piston linearly reciprocates in a cylinder by a linear motor located inside a sealed shell.

In some examples, the linear motor may include a permanent magnet that is located between an inner stator and an outer stator, and the permanent magnet may be driven to linearly reciprocate by a mutual electromagnetic force between the permanent magnet and the inner (or outer) stator. In some implementations, as the permanent magnet is driven while being connected to the piston, a refrigerant is suctioned, compressed, and then discharged while the piston linearly reciprocates inside the cylinder.

In some examples, the linear compressor may include a valve contact surface of an oil supplying device for a linear compressor. For example, oil may be directly supplied to a sliding part of a piston, and a portion of oil may be supplied to a vicinity of a valve to provide a seal between adjacent valves. In some cases, the linear compressor may include a structure to prevent leakage of refrigerant gas while it does not suction and discharge the refrigerant gas to improve efficiency of the linear compressor.

In some examples where the linear compressor includes only a device configured to prevent refrigerant from being leaked, heat transfer to a frame and a cylinder may be generated by a high-temperature discharge gas.

In some cases, a suction-side mechanism may be overheated due to heat transferred to the frame and the cylinder. For example, suction gas introduced into the compressor may be overheated, and the specific volume (e.g., an inverse of density) of suction gas may increase. In some examples, an increase of the specific volume of suction gas may deteriorate compression efficiency of the compressor.

SUMMARY

According to one aspect of the subject matter described in this application, a linear compressor includes a cylinder that defines a compression space configured to receive refrigerant, a piston that is located in the cylinder and that is configured to move in an axial direction of the cylinder and to compress refrigerant in the cylinder, a discharge cover that defines a discharge space configured to receive refrigerant discharged from the compression space, a frame configured to accommodate the cylinder and coupled to the discharge cover at a front side of the frame, and a plurality of blocking members that are located between the discharge cover and at least one of the frame or the cylinder. The plurality of blocking members are configured to restrict heat transfer to at least one of the frame or the cylinder from refrigerant discharged from the compression space.

Implementations according to this aspect may include one or more of the following features. For example, each blocking member may have a plate shape that covers an end of the frame or an end of the cylinder. In some examples, the linear compressor may further include a sealing member located between the frame and the discharge cover, and the plurality of blocking members may include a first blocking member arranged inside of the sealing member in a radial direction of the sealing member, and a second blocking member arranged outside of the sealing member in the radial direction of the sealing member.

In some implementations, the first blocking member may have a first inner circumferential surface that contacts the cylinder, and a first outer circumferential surface that contacts the sealing member. The second blocking member may have a second inner circumferential surface that contacts the sealing member, and a second outer circumferential surface that contacts an outer circumferential surface of the frame. The frame may define a gas passage configured to guide refrigerant toward an inner circumferential surface of the cylinder to form a gas bearing configured to reduce friction between the cylinder and the piston, and the first blocking member may define a gas hole communicating port that allows a portion of refrigerant discharged from the compression space to flow to the gas passage.

In some implementations, the frame may define a fastening hole configured to receive a fastening member that is configured to couple the discharge cover to the frame, and the second blocking member may define a fastening hole communicating port that communicates with the fastening hole of the frame and that allows the fastening member to pass through the second blocking member toward the fastening hole.

In some implementations, the cylinder may include a cylinder body configured to accommodate the piston, and a cylinder flange located at an outer side of a front portion of the cylinder body, where the frame includes a frame body configured to accommodate the cylinder body, and a frame flange that extends radially outward from a front portion of the frame body. The plurality of blocking members may contact an end of the frame flange and an end of the cylinder flange. The plurality of blocking members may extend in a radial direction of the cylinder body from an inner circumferential surface of the cylinder body toward an outer circumferential surface of the frame flange.

In some examples, the cylinder flange may include: a first flange that extends from an outer circumferential surface of the cylinder body in a radial direction of the cylinder body; and a second flange that extends from the first flange in an axial direction of the cylinder body, wherein the cylinder body includes a front cylinder part that extends in the axial direction of the cylinder body from an end of the cylinder body toward an end of the first flange. The cylinder may define a deformation space by the front cylinder part, the first flange, and the second flange, and the plurality of blocking members may cover a front side of the deformation space to restrict refrigerant from flowing into the deformation space.

In some implementations, the plurality of blocking members may include a material that has a thermal conductivity less than a thermal conductivity of the cylinder and a thermal conductivity of the frame. For example, the plurality of blocking members may include at least one of a non-asbestos gasket, a plastic material, or a heat-insulation material. The sealing member may have a ring shape, and an outer diameter of the sealing member may be greater than an outer diameter of the first blocking member, and less than an outer diameter of the second blocking member.

In some examples, the linear compressor may further include a second sealing member located at a side of the first flange opposite of the front cylinder part and configured to increase coupling force between the frame and the cylinder. The frame may define a recess configured to receive the second sealing member.

According to another aspect, a linear compressor includes a cylinder that defines a compression space configured to receive refrigerant, a piston that is located in the cylinder and that is configured to move in an axial direction of the cylinder and to compress refrigerant in the cylinder, a discharge cover that defines a discharge space configured to receive refrigerant discharged from the compression space, a frame that accommodates the cylinder and that is coupled to the discharge cover at a front side of the frame, a first blocking member located at an end of the frame and configured to restrict heat transfer to the frame from refrigerant discharged from the compression space, and a second blocking member located at an end of the cylinder and configured to restrict heat transfer to the cylinder from refrigerant discharged from the compression space.

Implementations according to this aspect may include one or more of the following features. For example, the first and second blocking members may have planar ring shapes that cover the end of the frame and the end of the cylinder, respectively. In some examples, the linear compressor may further include a sealing member that has a ring shape and that is located between the first blocking member and the second blocking member in a radial direction of the sealing member.

In some examples, an outer diameter of the sealing member may be greater than an outer diameter of the first blocking member, and less than an outer diameter of the second blocking member. The cylinder may include a cylinder body configured to accommodate the piston, and a cylinder flange located at an outer side of a front portion of the cylinder body. The frame may include a frame body configured to accommodate the cylinder body, and a frame flange that extends radially outward from a front portion of the frame body. The first blocking member may contact an end of the frame flange, and the second blocking member may contact an end of the cylinder flange.

The details of one or more implementations are set forth in the accompanying drawings and the following description. Other features will be apparent from the description and drawings, and from the claims.

DETAILED DESCRIPTION

Reference will now be made in detail to the implementations of the present disclosure, examples of which are illustrated in the accompanying drawings.

Figure 1:
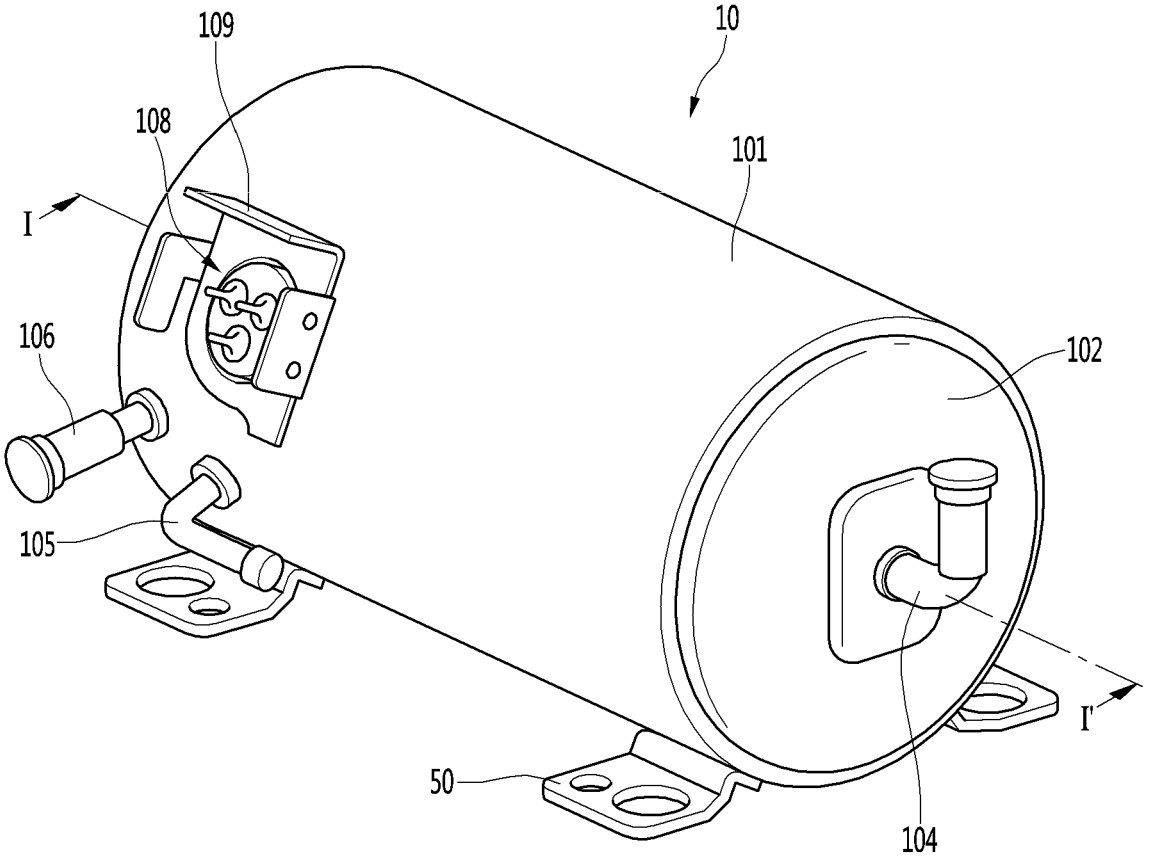
FIG. 1 is a perspective view illustrating an outer appearance of an example linear compressor.
Figure 2:
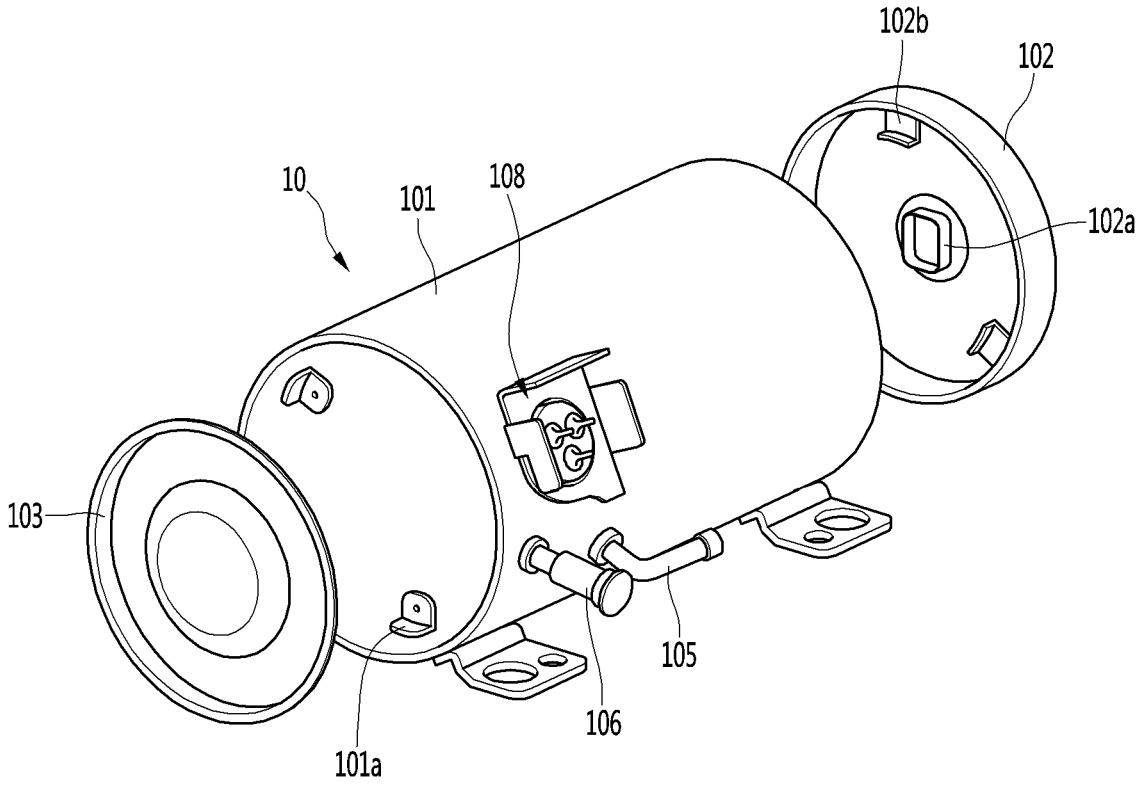
FIG. 2 is an exploded perspective view illustrating an example shell and an example shell cover of the linear compressor.

FIG. 1 illustrates an outer appearance of an example linear compressor, and FIG. 2 is an exploded perspective view illustrating an example shell and an example shell cover of the linear compressor.

Referring to FIGS. 1 and 2, a linear compressor 10 includes a shell 101 and shell covers 102 and 103 coupled to the shell 101. For example, the first shell cover 102 and the second shell cover 103 may be one configuration of the shell 101.

Legs 50 may be coupled to a lower portion of the shell 101. The legs 50 may be coupled to a base of a product in which the linear compressor 10 is installed. For example, the product includes a refrigerator, and the base includes a base of a machine room of the refrigerator. As another example, the product includes an outdoor unit of an air conditioner, and the base includes a base of the outdoor unit.

The shell 101 may have an approximately cylindrical shape, and may be arranged to be laid transversely or to be stood axially. Based on FIG. 1, the shell 101 may transversely extend, and may have a slightly low height in a radial direction. In some examples where the linear compressor 10 may have a low height, there is an advantage when the linear compressor 10 is installed in the base of the machine room of the refrigerator because the height of the machine room may be reduced.

A terminal 108 may be installed on an outer surface of the shell 101. The terminal 108 may be configured to transfer external power to a motor assembly 140 (see FIG. 3) of the linear compressor. The terminal 108 may be connected to a lead wire of a coil 141*c* (see FIG. 3).

A bracket 109 is installed on the outer side of the terminal 108. The bracket 109 may include a plurality of brackets surrounding the terminal 108. The bracket 109 may function to protect the terminal 108 from an external impact or the like.

Opposite sides of the shell 101 may be opened. The shell covers 102 and 103 may be coupled to the opened opposite sides of the shell 101. For example, the shell covers 102 and 103 may respectively include a first shell cover 102 coupled to one opened side of the shell 101 and a second shell cover 103 coupled to the opened other side of the shell 101. An inner space of the shell 101 may be sealed by the shell covers 102 and 103.

Referring to FIG. 1, the first shell cover 102 may be located on a right side of the linear compressor 10, and the second shell cover 103 may be located on a left side of the linear compressor 10. In other words, the first and second shell covers 102 and 103 may be arranged to face each other.

The linear compressor 10 may further include a plurality of pipes 104, 105, and 106 provided in the shell 101 or the shell covers 102 and 103 to suction, discharge or inject a refrigerant.

The plurality of pipes 104, 105, and 106 include a suction pipe 104 through which the refrigerant is suctioned into the linear compressor 10, a discharge pipe 105 through which the compressed refrigerant is discharged from the linear compressor 10, and a process pipe 106 through which the refrigerant is supplemented to the linear compressor 10.

For example, the suction pipe 104 may be coupled to the first shell cover 102. The refrigerant may be suctioned into the linear compressor 10 along an axial direction through the suction pipe 104.

The discharge pipe 105 may be coupled to an outer circumferential surface of the shell 101. The refrigerant suctioned through the suction pipe 104 may be compressed while flowing in an axial direction. In some implementations, the compressed refrigerant may be discharged through the discharge pipe 105. The discharge pipe 105 may be arranged to be closer to the second shell cover 103 than the first shell cover 102.

The process pipe 106 may be coupled to the outer circumferential surface of the shell 101. A worker may inject the refrigerant into the linear compressor 10 through the process pipe 106.

The process pipe 106 may be coupled to the shell 101 at a height that is different from that of the discharge pipe 105, to avoid interference with the discharge pipe 105. The height is a distance from the leg 50 in a vertical direction (or a radial direction). The discharge pipe 105 and the process pipe 106 are coupled to the outer circumferential surface of the shell 101 at different heights, so that a worker may achieve work convenience.

At least a portion of the second shell cover 103 may be located to be adjacent to an inner circumferential surface of the shell 101, which corresponds to a point where the process pipe 106 is coupled. In other words, at least a portion of the second shell cover 103 may act as resistance of the refrigerant injected through the process pipe 106.

In terms of a passage of refrigerant, the size of the passage of refrigerant introduced through the process pipe 106 is reduced toward an inner space of the shell 101. In this process, because the pressure of the refrigerant is reduced, the refrigerant may be evaporated. In this process, oil included in the refrigerant may be separated. For instance, the refrigerant, from which the oil is separated, may be introduced into a piston 130 (see FIG. 3), where compression performance of the refrigerant may be improved. The oil may include working oil existing in a cooling system.

A cover support 102*a* is located on an inner surface of the first shell cover 102. A second support device 185, which will be described below, may be coupled to the cover support 102*a*. The cover support 102*a* and the second support device 185 may be configured to support a body of the linear compressor 10. For instance, the body of the compressor may be a component located inside the shell 101, and may include a driving part reciprocating in a front-rear direction and a support part configured to support the driving part, which will be described below. The driving part may include the piston 130, a magnet frame 138, a permanent magnet 146, a supporter 137, a suction muffler 150, and the like. In some implementations, the support part may include resonance springs 176*a* and 176*b*, a rear cover 170, a stator cover 149, a first support device 165, a second support device 185, and the like.

A stopper 102*b* may be located on an inner surface of the first shell cover 102. The stopper 102*b* may be configured to prevent the body of the compressor, for example, the motor assembly 140, from being damaged by collision with the shell 101 due to vibration or impact generated during transportation of the linear compressor 10. The stopper 102*b* is located to be adjacent to the rear cover 170, which will be described below, and when the linear compressor 10 is shaken, the rear cover 170 interferes with the stopper 102*b*, so that an impact may be prevented from being transferred to the motor assembly 140.

Spring fastened parts 101*a* may be located on an inner circumferential surface of the shell 101. For example, the spring fastened parts 101*a* may be arranged to be adjacent to the second shell cover 103. The spring fastened parts 101*a* may be coupled to a first support spring 166 of the first support device 165, which will be described below. As the spring fastened parts 101*a* and the first support device 165 are coupled to each other, the body of the compressor may be stably supported on an inner side of the shell 101.

Figure 3:
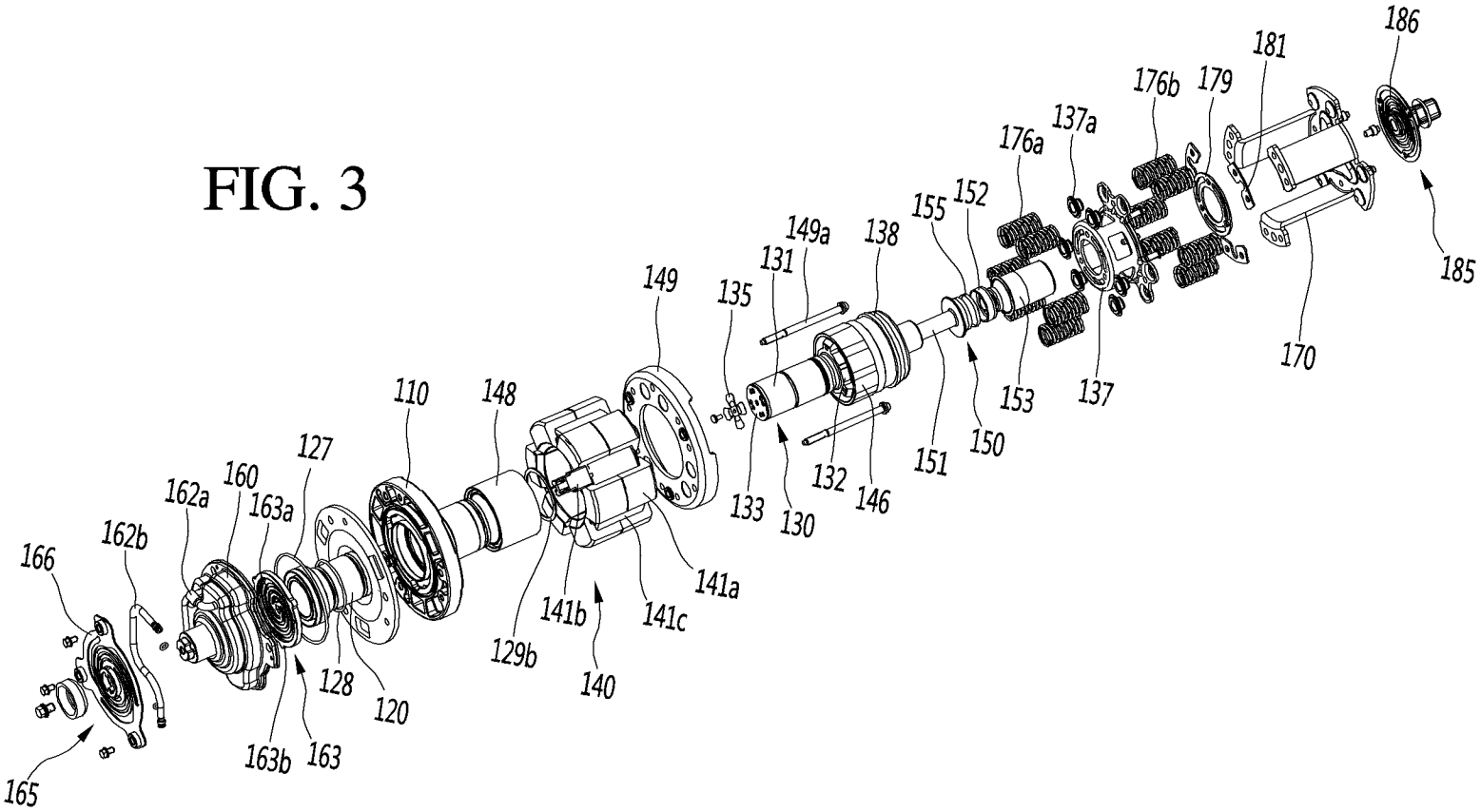
FIG. 3 is an exploded perspective view illustrating example internal components of the linear compressor.
Figure 4:
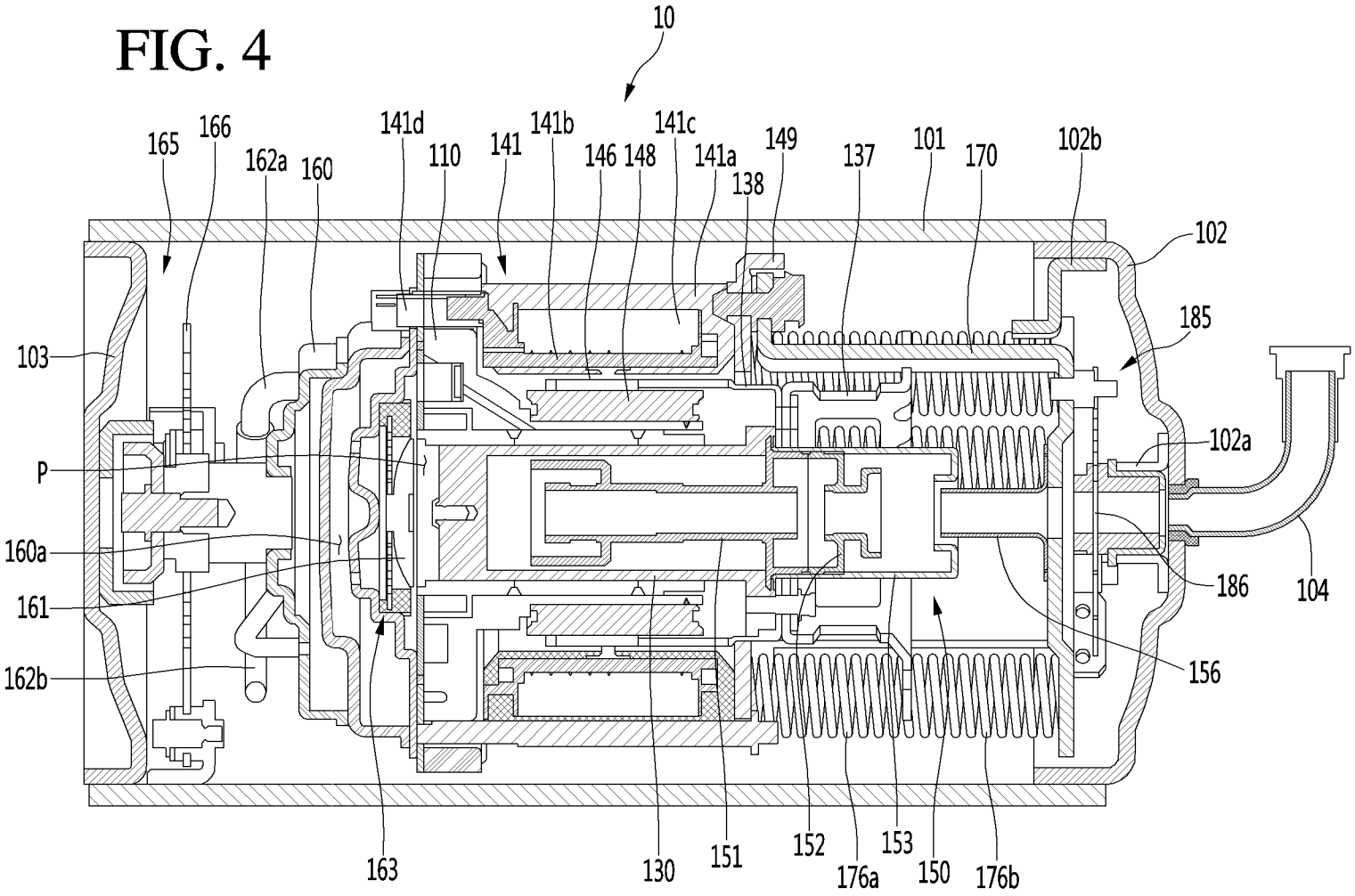
FIG. 4 is a sectional view taken along line I-I' of FIG. 1.

FIG. 3 is an exploded perspective view illustrating internal components of the linear compressor, and FIG. 4 is a sectional view illustrating an internal configuration of the linear compressor.

Referring to FIGS. 3 and 4, the linear compressor 10 includes a cylinder 120 located inside the shell 101, the piston 130 linearly reciprocating inside the cylinder 120, and the motor assembly 140 as a linear motor configured to provide a driving force to the piston 130. When the motor assembly 140 is driven, the piston 130 may reciprocate in an axial direction.

The linear compressor 10 further includes the suction muffler 150 coupled to the piston 130 and configured to reduce noise generated by the refrigerant suctioned through the suction pipe 104. The refrigerant suctioned through the suction pipe 104 flows to an inside of the piston 130 via the suction muffler 150. For example, while the refrigerant passes through the suction muffler 150, flow noise of the refrigerant may be reduced.

The suction muffler 150 includes a plurality of mufflers 151, 152, and 153. The plurality of mufflers 151, 152, and 153 include a first muffler 151, a second muffler 152, and a third muffler 153.

The first muffler 151 is located inside the piston 130, and the second muffler 152 is coupled to a rear portion of the first muffler 151. In some implementations, the third muffler 153 may accommodate the second muffler 152 therein, and may extend to the rear side of the first muffler 151. In terms of a flow direction of the refrigerant, the refrigerant suctioned through the suction pipe 104 may sequentially pass through the third muffler 153, the second muffler 152, and the first muffler 151. In this process, the flow noise of the refrigerant may be reduced.

The suction muffler 150 includes a muffler filter 155. The muffler filter 155 may be located on a boundary surface on which the first muffler 151 and the second muffler 152 are coupled to each other. For example, the muffler filter 155 may have a circular shape, and an outer circumference of the muffler filter 155 may be supported between the first and second mufflers 151 and 152.

Hereinafter, directions will be defined.

An axial direction may be a direction in which the piston 130 reciprocates, for example, a horizontal direction in FIG. 4. In some implementations, in the axial direction, a forward direction is defined as a direction from the suction pipe 104 to a compression space P, for example, a direction in which the refrigerant flows, and a rearward direction is defined as a direction that is opposite to the forward direction. For example, when the piston 130 is moved in the front or forward direction, the compression space P may be compressed.

A radial direction may be a direction that is perpendicular to the direction in which the piston 130 reciprocates, for example, a vertical direction in FIG. 4.

The piston 130 includes an approximately cylindrical piston body 131 and a piston flange 132 extending from the piston body 131 in the radial direction. The piston body 131 may reciprocate inside the cylinder 120, and the piston flange 132 may reciprocate outside the cylinder 120.

The cylinder 120 is configured to accommodate at least a portion of the first muffler 151 and at least a portion of the piston body 131.

The compression space P in which the refrigerant is compressed by the piston 130 is formed inside the cylinder 120. In some implementations, suction holes 133 through which the refrigerant is introduced into the compression space P are formed on a front surface of the piston body 131, and a suction valve 135 configured to selectively open the suction holes 133 is located on the front side of the suction holes 133. A fastening hole to which a predetermined fastening member is coupled is formed at an approximately central portion of the suction valve 135.

A discharge cover 160 defining a discharge space 160*a* for the refrigerant discharged from the compression space P and discharge valve assemblies 161 and 163 coupled to the discharge cover 160 to selectively discharge the refrigerant compressed in the compression space P are located in front of the compression space P. The discharge space 160*a* includes a plurality of space parts partitioned by an inner wall of the discharge cover 160. The plurality of space parts may be arranged in a front-rear direction, and may communicate with each other.

The discharge valve assemblies 161 and 163 include a discharge valve 161 which is, when the pressure of the compression space P is not less than a discharge pressure, opened to introduce the refrigerant into the discharge space 160*a* of the discharge cover 160, and a spring assembly 163 which is located between the discharge valve 161 and the discharge cover 160 to provide an elastic force in the axial direction.

The spring assembly 163 includes a valve spring 163*a* and a spring support 163*b* configured to support the valve spring 163*a* on the discharge cover 160. For example, the valve spring 163*a* may include a leaf spring. In some implementations, the spring support 163*b* may be injection-molded integrally with the valve spring 153*a* through an injection molding process.

The discharge valve 161 is coupled to the valve spring 163*a*, and a rear side or a rear surface of the discharge valve 161 is located to be supported on the front surface of the cylinder 120. When the discharge valve 161 is supported on the front surface of the cylinder 120, the compression space P maintains a sealed state, and when the discharge valve 161 is spaced apart from the front surface of the cylinder 120, the compression space P is opened, so that the compressed refrigerant inside the compression space P may be discharged.

The compression space P is defined between the suction valve 135 and the discharge valve 161. In some implementations, the suction valve 135 may be formed on one side of the compression space P, and the discharge valve 161 may be located on the other side of the compression space P, that is, on a side that is opposite to the suction valve 135.

While the piston 130 linearly reciprocates inside the cylinder 120, when the pressure of the compression space P is lower than a discharge pressure and not more than a suction pressure, the suction valve 135 is opened, so that the refrigerant is suctioned into the compression space P. On the other hand, when the pressure of the compression space P is not less than the suction pressure, in a state in which the suction valve 135 is closed, the refrigerant of the compression space P is compressed.

In some examples, when the pressure of the compression space P is equal to or greater than the discharge pressure, the valve spring 163*a* is deformed to the front side to open the discharge valve 161, and the refrigerant is discharged from the compression space P to a discharge space of the discharge cover 160. When the refrigerant is completely discharged, the valve spring 163*a* provides a restoring force to the discharge valve 161, so that the discharge valve 161 is closed.

The linear compressor 10 further includes a cover pipe 162*a* coupled to the discharge cover 160 to discharge the refrigerant flowing through the discharge space 160*a* of the discharge cover 160. For example, the cover pipe 162*a* may be made of metal.

In some implementations, the linear compressor 10 further includes a loop pipe 162*b* coupled to the cover pipe 162*a* to transfer the refrigerant flowing through the cover pipe 162*a* to the discharge pipe 105. One side of the loop pipe 162*b* may be coupled to the cover pipe 162*a*, and the other side of the loop pipe 162*b* may be coupled to the discharge pipe 105.

The loop pipe 162*b* may be made of a flexible material, and may be formed to be relatively long. In some implementations, the loop pipe 162*b* may extend from the cover pipe 162*a* along the inner circumferential surface of the shell 101 to be rounded, and may be coupled to the discharge pipe 105. For example, the loop pipe 162*b* may have a wound shape.

The linear compressor 10 further includes a frame 110. The frame 110 is configured to fix the cylinder 120. For example, the cylinder 120 may be press-fitted to an inside of the frame 110. In some implementations, the cylinder 120 and the frame 110 may be made of aluminum or aluminum alloy.

The frame 110 is arranged to surround the cylinder 120. That is, the cylinder 120 may be located to be accommodated inside the frame 110. In some implementations, the discharge cover 160 may be coupled to a front surface of the frame 110 through a fastening member.

The motor assembly 140 includes an outer stator 141 fixed to the frame 110 and arranged to surround the cylinder 120, an inner stator 148 spaced apart from an inner side of the outer stator 141, and the permanent magnet 146 located in a space between the outer stator 141 and the inner stator 148.

The permanent magnet 146 may linearly reciprocate by a mutual electromagnetic force of the outer stator 141 and the inner stator 148. In some implementations, the permanent magnet 146 may be configured as a single magnet having one pole or may be configured by coupling a plurality of magnets having three poles.

The permanent magnet 146 may be installed in the magnet frame 138. The magnet frame 138 may have an approximately cylindrical shape, and may be inserted into a space between the outer stator 141 and the inner stator 148.

In detail, based on the sectional view of FIG. 4, the magnet frame 138 may be coupled to the piston flange 132 to extend in an outward radial direction and to be bent in the front direction. The permanent magnet 146 may be installed on a front side of the magnet frame 138. When the permanent magnet 146 reciprocates, the piston 130 may reciprocate in the axial direction together with the permanent magnet 146.

The outer stator 141 includes coil wound bodies 141*b*, 141*c*, and 141*d*, and a stator core 141*a*. The coil wound bodies 141*b*, 141*c*, and 141*d* include a bobbin 141*b* and a coil 141*c* wound in a circumferential direction of the bobbin 141*b*.

In some implementations, the coil wound bodies 141*b*, 141*c*, and 141*d* further include a terminal 141*d* configured to guide a power line connected to the coil 141*c* such that the power line is withdrawn or exposed to the outside of the outer stator 141. The terminal 141*d* may be inserted into terminal inserting parts 119*c* (see FIG. 6) located in the frame 110.

The stator core 141*a* includes a plurality of core blocks configured by stacking a plurality of laminations in a circumferential direction. The plurality of core blocks may be arranged to surround at least a portion of the coil wound bodies 141*b* and 141*c*.

A stator cover 149 is located on one side of the outer stator 141. That is, one side of the outer stator 141 may be supported by the frame 110, and the other side of the outer stator 141 may be supported by the stator cover 149.

The linear compressor 10 further includes cover fastening members 149*a* configured to fasten the stator cover 149 and the frame 110. The cover fastening members 149*a* may pass through the stator cover 149 to extend toward the frame 110 in the front direction, and may be coupled to first fastening hole 119*a* (see FIG. 6) of the frame 110.

The inner stator 148 is fixed to an outer circumference of the frame 110. In some implementations, the inner stator 148 is configured by stacking a plurality of laminations on an outer side of the frame 110 in the circumferential direction.

The linear compressor 10 further includes the supporter 137 configured to support the piston 130. The supporter 137 may be coupled to a rear portion of the piston 130, and the suction muffler 150 may be arranged inside the supporter 137 to pass through the supporter 137. The piston flange 132, the magnet frame 138, and the supporter 137 may be fastened to each other through a fastening member.

A balance weight 179 may be coupled to the supporter 137. The weight of the balance weight 179 may be determined based on a range of an operating frequency of the body of the compressor.

The linear compressor 10 further includes a rear cover 170 coupled to the stator cover 149 to extend rearward, and supported by the second support device 185.

In detail, the rear cover 170 includes three support legs, and the three support legs may be coupled to a rear surface of the stator cover 149. A spacer 181 may be interposed between the three support legs and the stator cover 149. A distance between the stator cover 149 and a rear end of the rear cover 170 may be determined by adjusting the thickness of the spacer 181. In some implementations, the rear cover 170 may be spring-supported on the supporter 137.

The linear compressor 10 further includes an inlet guide 156 coupled to the rear cover 170 to guide inflow of the refrigerant to the suction muffler 150. At least a portion of the inlet guide 156 may be inserted into the suction muffler 150.

The linear compressor 10 further includes the plurality of resonance springs 176*a* and 176*b* having natural frequencies which are adjusted such that the piston 130 may resonate.

The plurality of resonance springs 176*a* and 176*b* include a first resonance spring 176*a* supported between the supporter 137 and the stator cover 149, and a second resonance spring 176*b* supported between the supporter 137 and the rear cover 170. Stable movement of the driving part reciprocating inside the linear compressor 10 may be performed by the action of the plurality of resonance springs 176*a* and 176*b*, and an amount of vibration or noise generated due to the movement of the driving part may be reduced.

The supporter 137 includes a first spring support 137*a* coupled to the first resonance spring 176*a*.

The linear compressor 10 further includes the first support device 165 coupled to the discharge cover 160 to support one side of the body of the compressor 10. The first support device 165 may be arranged to be adjacent to the second shell cover 103 to elastically support the body of the compressor 10. In detail, the first support device 165 includes the first support spring 166. The first support spring 166 may be coupled to the spring fastened parts 101*a*.

The linear compressor 10 further includes the second support device 185 coupled to the rear cover 170 to support the other side of the body of the compressor 10. The second support device 185 may be coupled to the first shell cover 102 to elastically support the body of the compressor 10. In detail, the second support device 185 includes a second support spring 186. The second support spring 186 may be coupled to the cover support 102*a*.

The linear compressor 10 includes the frame 110 and a plurality of sealing members 127, 128, 129*a*, and 129*b* for increasing coupling force between components near the frame 110.

In detail, the plurality of sealing members 127, 128, 129*a*, and 129*b* include a first sealing member 127 located at a portion where the frame 110 and the discharge cover 160 are coupled to each other. In some implementations, the plurality of sealing members 128, 128, 129*a*, and 129*b* further include a second sealing member 128 provided at a portion where the frame 110 and the cylinder 120 are coupled to each other.

In some implementations, the plurality of sealing members 127, 128, 129*a*, and 129*b* further include a third sealing member 129*a* located between the cylinder 120 and the frame 110. In some implementations, the plurality of sealing members 127, 128, 129*a*, and 129*b* further include a fourth sealing member 129*b* located at a portion where the frame 110 and the inner stator 148 are coupled to each other.

The first to fourth sealing members 127, 128, 129*a*, and 129*b* may have a ring shape.

Figure 5:
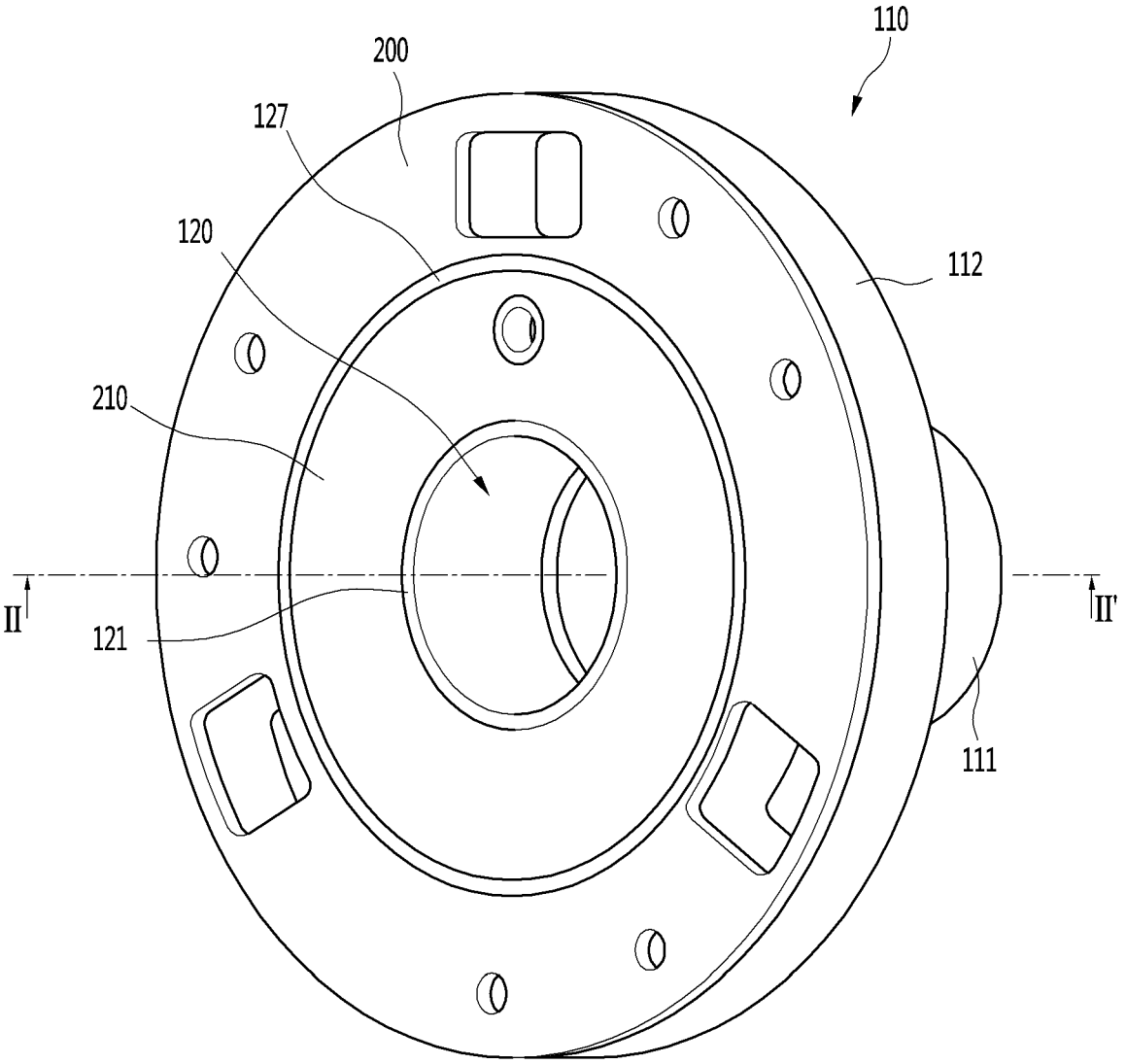
FIG. 5 is a perspective view illustrating an example frame and an example cylinder that are coupled to an example blocking member.
Figure 6:
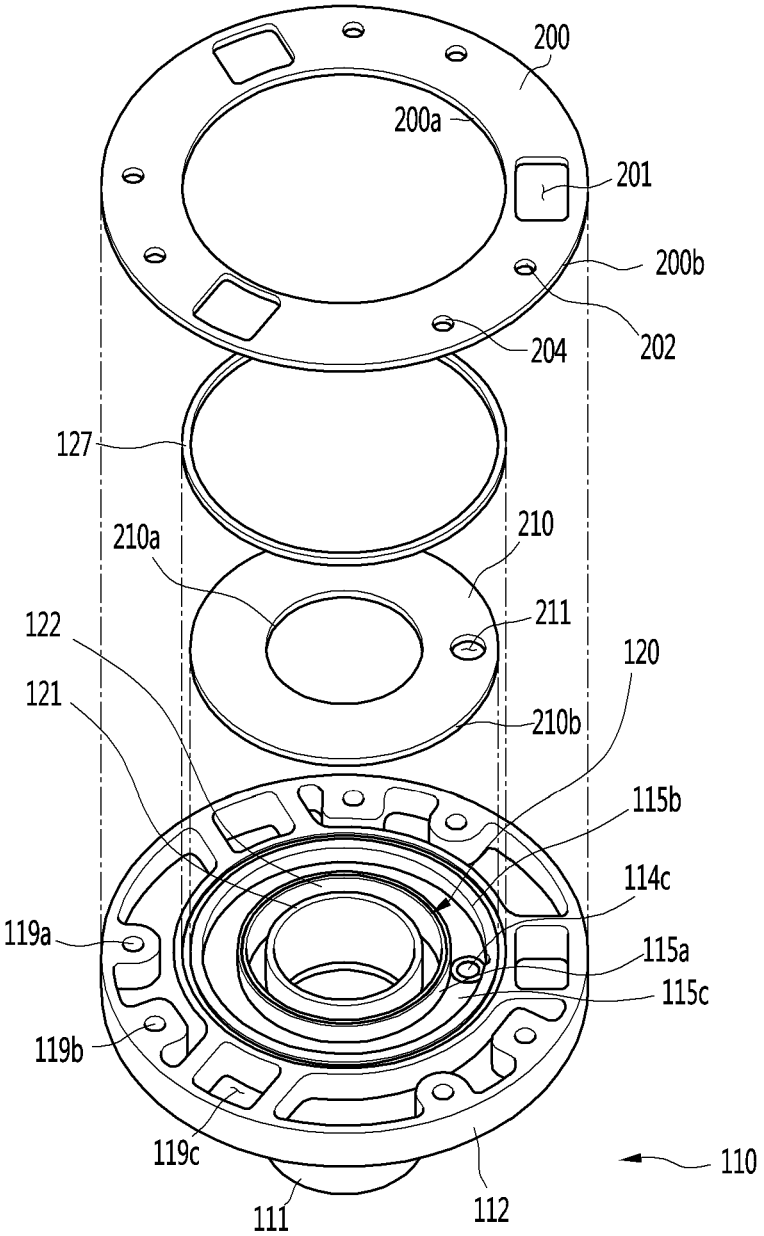
FIG. 6 is a perspective view illustrating the frame and the cylinder that are disassembled from the blocking member.
Figure 7:
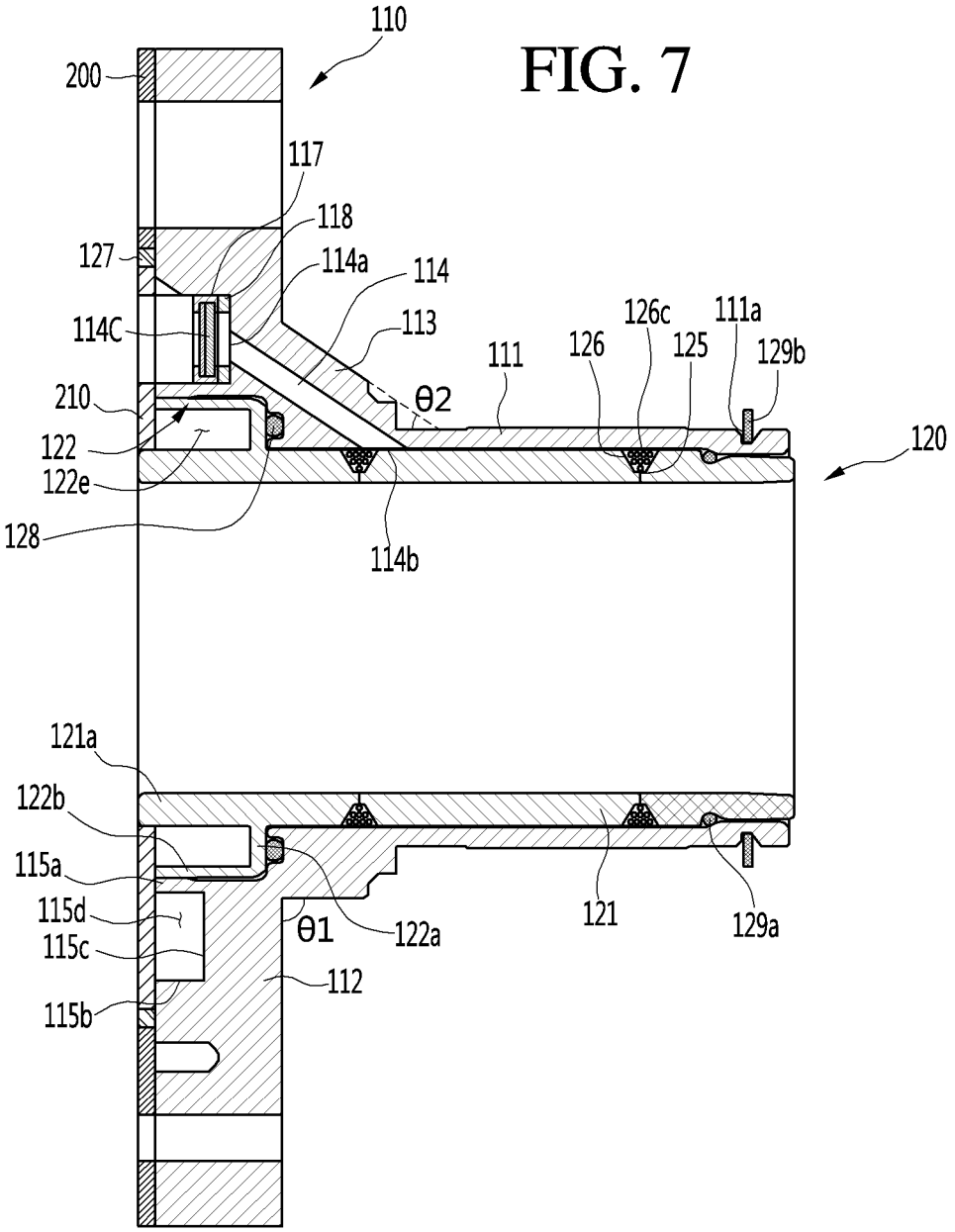
FIG. 7 is a sectional view taken along line II-II' of FIG. 5.

FIG. 5 is a perspective view illustrating a state in which a frame and a cylinder are coupled to a blocking member, FIG. 6 is a perspective view illustrating a state in which the frame and the cylinder are disassembled from the blocking member, and FIG. 7 is a sectional view taken along line II-II' of FIG. 5.

Referring to FIGS. 5 to 7, the cylinder 120 may be coupled to the frame 110. For example, the cylinder 120 may be inserted into the frame 110.

The frame 110 includes a frame body 111 extending in an axial direction and a frame flange 112 extending radially outward from the frame body 111. In other words, as illustrated in FIG. 7, the frame flange 112 may extend from an outer peripheral surface of the frame body 111 to form a first setting angle θ1. For example, the first setting angle θ1 may be about 90 degrees.

The frame body 111 has a cylindrical shape having a central axis in an axial direction, and has a body accommodating part in which the cylinder body 121 is accommodated. In some implementations, a first installation groove 111*a* into which a fourth sealing member 129*b* arranged between the inner stator 148 and the frame body 111 is inserted may be formed at a rear portion of the frame body 111.

The frame flange 112 includes a first wall 115*a* having a ring shape and coupled to the cylinder 120, a second wall 115*b* spaced outward apart from the first wall 115*a* and having a ring shape, and a third wall 115*c* connecting the first wall 115*a* and the second wall 115*b*.

The first wall 115*a* and the second wall 115*b* may extend in an axial direction, and the third wall 115*c* may extend in a radial direction. As illustrated in FIGS. 6 and 7, a frame space 115*d* is defined by the first to third walls 115*a*, 115*b*, and 115*c*. The frame space 115*d* is recessed rearward from a tip end of the frame flange 112, and form a portion of a discharge passage through which the refrigerant discharged through the discharge valve 161 flows.

In some implementations, the frame flange 112 includes fastening holes 119*a* and 119*b* to which predetermined fastening members are coupled for fastening between the frame 110 and peripheral components. The fastening holes 119*a* and 119*b* may be arranged in plurality along an outer circumference of the second wall 115*b*.

The fastening holes 119*a* and 119*b* include first fastening holes 119*a* to which the cover fastening members 149*a* are coupled. The first fastening holes 119*a* may be provided in plurality to be spaced apart from each other. For example, the three first fastening holes 119*a* may be formed.

The fastening holes 119*a* and 119*b* further include second fastening holes 119*b* to which predetermined fastening members configured to fasten the discharge cover 160 and the frame 110 are coupled. The second fastening holes 119*b* may be provided in plurality to be spaced apart from each other. For example, the three second fastening holes 119*b* may be formed.

Because the three first fastening holes 119*a* and the three second fastening holes 119*b* are arranged along the outer circumference of the second wall 115*b*, that is, are evenly arranged in a circumferential direction with respect to a central portion of the frame 110, the frame 110 may be supported at three points on the peripheral components, that is, the stator cover 149 and the discharge cover 160, and thus may be stably coupled.

In some implementations, the terminal inserting parts 119*c* providing a withdrawal passage of the terminal 141*d* of the motor assembly 140 are formed in the frame flange 112. The terminal inserting parts 119*c* are formed by cutting the frame flange 112 in a front-rear direction.

The terminal 141*d* may extend forward from the coil 141*c* and may be inserted into the terminal inserting part 119*c*. According to such a configuration, the terminal 141*d* may be exposed to the outside from the motor assembly 140 and the frame 110, and may be connected to a cable heading to the terminal 108.

The terminal inserting parts 119*c* may be provided in plurality, and the plurality of terminal inserting parts 119*c* may be arranged along the outer circumference of the second wall 115*b*. Among the plurality of terminal inserting parts 119*c*, only one of the terminal inserting parts 119*c* may receive the terminal 141*d*. The other terminal inserting parts 119*c* may prevent deformation of the frame 110.

For example, three terminal inserting parts 119*c* are formed in the frame flange 112. The terminal 141*d* is inserted into one terminal inserting part among the three terminal inserting parts 119*c*, and is not inserted into the other two terminal inserting parts among the three terminal inserting parts 119*c*.

A large amount of stress may be applied to the frame 110 while the frame 110 is fastened to the stator cover 149 or the discharge cover 160 or is press-fitted to the cylinder 120. When only one terminal inserting part 119*c* is formed in the frame flange 112, the stress is concentrated at a specific point, and thus, the frame flange 112 may be deformed.

In some implementations, as the terminal inserting parts 119*c* are formed at three points of the frame flange 112, that is, are evenly arranged in a circumferential direction with respect to a central portion of the frame 110, the stress may be prevented from being concentrated.

The frame 110 further includes a frame connecting part 113 slantingly extending from the frame flange 112 toward the frame body 111. An outer surface of the frame connecting part 113 may extend to form a second setting angle θ2 with respect to an outer circumferential surface of the frame body 111, that is, an axial direction. For example, the second setting angle θ2 may have a value that is larger than 0 degree and is smaller than 90 degrees.

A gas hole 114 configured to guide the refrigerant discharged from the discharge valve 161 to the cylinder 120 is formed in the frame connecting part 113. The gas hole 114 may be formed through an interior of the frame connecting part 113.

In detail, the gas hole 114 may extend from the frame flange 112 via the frame connecting part 113 to the frame body 111.

Because the gas hole 114 is formed through a portion of a frame having a somewhat large thickness from the frame flange 112 via the frame connecting part 113 to the frame body 111, the strength of the frame 110 may be prevented from being weakened by forming the gas hole 114.

An extending direction of the gas hole 114 may form the second setting angle θ2 with respect to an inner circumferential surface of the frame body 111, that is, the axial direction, to correspond to an extending direction of the frame connecting part 113.

A discharge filter 114*c* configured to filter foreign matters from the refrigerant to be introduced into the gas hole 114 may be arranged in an inlet 114*a* of the gas hole 114. The discharge filter 114*c* may be installed on the third wall 115*c*.

In detail, the discharge filter 114*c* is installed in a filter groove 117 formed in the frame flange 112. The filter groove 117 may be recessed rearward from the third wall 115*c*, and may have a shape corresponding to the shape of the discharge filter 114*c*.

In other words, the inlet 114*a* of the gas hole 114 may be connected to the filter groove 117, and the gas hole 114 may extend from the filter groove 117 to the inner circumferential surface of the frame body 111 to pass through the frame flange 112 and the frame connecting part 113. In some examples, an outlet 114*b* of the gas hole 114 may communicate with the inner circumferential surface of the frame body 111.

In some implementations, a filter sealing member 118 is installed at a rear portion of the discharge filter 114*c*. The filter sealing member 118 may have an approximately ring shape. In detail, the filter sealing member 118 may be placed on the filter groove 117, and the discharge filter 114*c* may be press-fitted to the filter groove 117 while pressing the filter sealing member 118.

In some examples, the frame connecting part 113 may be provided in plurality along the circumference of the frame body 111. Among the plurality of frame connecting parts 113, the gas hole 114 is provided in only one frame connecting part 113. The other frame connecting parts 113 are provided to prevent deformation of the frame 110.

As described above, the cylinder 120 is coupled to an inside of the frame 110. For example, the cylinder 120 may be coupled to the frame 110 through a press-fitting process.

The cylinder 120 includes a cylinder body 121 extending in the axial direction and a cylinder flange 122 located on an outer side of a front side of the cylinder body 121. The cylinder body 121 has a cylindrical shape having an axial central axis, and is inserted into the frame body 111. In some examples, the outer circumferential surface of the cylinder body 121 may be located to face the inner circumferential surface of the frame body 111.

A gas inlet 126 into which a gas refrigerant flowing through the gas hole 114 is introduced is formed in the cylinder body 121. Accordingly, a gas pocket through which a gas for a bearing flows may be formed between the inner circumferential surface of the frame 110 and the outer circumferential surface of the cylinder 120.

In detail, the gas inlet 126 may be recessed radially inward from the outer circumferential surface of the cylinder body 121. In some implementations, the gas inlet 126 may have a circular shape along the outer circumferential surface of the cylinder body 121 with respect to an axial central axis. The gas inlet 126 may be provided in plurality. For example, the number of gas inlets 126 may be two.

Cylinder filter members 126*c* may be installed in the gas inlets 126. The cylinder filter members 126*c* may prevent foreign matters from being introduced into the cylinder 120, and adsorb oil included in the refrigerant. Here, the predetermined size may be 1 μm.

The cylinder body 121 includes a cylinder nozzle 125 extending radially inward from the gas inlet 126. The cylinder nozzle 125 may extend to the inner circumferential surface of the cylinder body 121. That is, the cylinder nozzle 125 may be configured to supply the refrigerant to the outer peripheral surface of the piston 130.

In some examples, the refrigerant filtered by the cylinder filter members 126*c* while passing through the gas inlets 126 is introduced into a space between the inner circumferential surface of the cylinder body 121 and the outer circumferential surface of the piston body 131 through the cylinder nozzle 125. The gas refrigerant flowing to the outer circumferential surface of the piston body 131 functions as a gas bearing for the piston 130 by providing a floating force to the piston 130.

The cylinder flange 122 includes a first flange 122*a* extending radially outward from the cylinder body 121 and a second flange 122*b* extending forward from the first flange 122*a*. Here, a portion of the cylinder body 121 located in front of the first flange 122*a* is called a front cylinder part 121*a*.

The second sealing member 128 is arranged on a rear side of the first flange 122*a*. The second sealing member 128 may be arranged between the frame 110 and the cylinder 120 to increase a coupling force between the frame 110 and the cylinder 120. As illustrated in FIG. 7, the second sealing member 128 may be recessed and installed in the frame 110.

As illustrated in FIG. 7, the front cylinder part 121*a* and the first and second flanges 122*a* and 122*b* define a deformation space 122*e* enabling deformation that may be generated while the cylinder 120 is press-fitted to the frame 110.

In detail, the second flange 122*b* may be press-fitted to the inner surface of the first wall 115*a* of the frame 110. In the press-fitting process, the second flange 122*b* may be deformed toward the deformation space 122*e*. The second flange 122*b* is spaced outward apart from the cylinder body 121, so that even when deformation is generated, the cylinder body 121 is not affected. Thus, the cylinder body 121 interacting with the piston 130 may not be deformed.

However, when the cylinder 120 is coupled to the frame 110, and the refrigerant is compressed, the high-temperature refrigerant is introduced into the deformation space 122*e*, so that the deformation space 122*e* is deformed, which affects the cylinder 120. In some implementations, heat may be transferred from the high-temperature refrigerant flowing inside the discharge cover 160 to the cylinder 120 and the frame 110.

For example, as described above, because the cylinder 120 and the frame 110 is formed of aluminum or aluminum alloy, thermal conductivities thereof are high. Accordingly, because the heat is transferred to a suction side through the cylinder 120 and the frame 110, and the temperature of the suctioned refrigerant increases, the entire efficiency of the compressor may deteriorate.

To prevent the deformation of the cylinder 120 and the heat transfer to the cylinder 120 and the frame 110, the compressor 10 further includes blocking members 200 and 210.

As illustrated in FIG. 5, the blocking members 200 and 210 are arranged at tip ends of the frame 110 and the cylinder 120. The blocking members 200 and 210 include a first blocking member 210 located on an inner side with respect to the first sealing member 127 and a second blocking member 200 located on an outer side with respect to the first sealing member 127.

As illustrated in FIG. 6, the first blocking member 210 and the second blocking member 200 may have a donut-shaped flat plate having a predetermined thickness.

The first blocking member 210 includes a first outer circumferential surface 210*b* in contact with the first sealing member 127 and a first inner circumferential surface 210*a* in contact with the cylinder 120. For example, the first inner circumferential surface 210*a* is in contact with the front cylinder part 121*a* of the cylinder body 121. That is, as illustrated in FIG. 7, the first blocking member 210 is seated at the tip ends of the cylinder 120 and the frame 110.

Accordingly, the first blocking member 210 may prevent flow of the refrigerant to the deformation space 122*e*. That is, the high-temperature refrigerant does not flow to the deformation space 122*e* due to the first blocking member 210, so that the deformation space 122*e* may be prevented from being deformed when the compressor 10 is driven.

In some implementations, the first blocking member 210 includes a gas hole communicating port 211 communicating with the gas hole 114. The gas hole communicating port 211 is formed in the first blocking member 210 to correspond to the location of the filter groove 117.

In some implementations, the first blocking member 210 may prevent a large amount of the discharged refrigerant from being introduced into the frame space 115*d*. In detail, a front portion of the frame space 115*d* except for the gas hole communicating port 211 is shielded by the first blocking member 210.

For example, the above-described refrigerant, which functions as the gas bearing, may pass through the gas hole communicating port 211 to flow to the gas hole 114. Accordingly, the heat may hardly be transferred to the frame 110.

In some implementations, the front surface of the front cylinder part 121*a* may protrude forward from the tip end of the frame 110 including the second flange 122*b*, and front portions of the first wall 115*a* and the second wall 115*b* by the thickness of the first blocking member 210. That is, when the first blocking member 210 is seated at the tip ends of the cylinder 120 and the frame 110, the front surface of the front cylinder part 121*a* and the front surface of the first blocking member 210 may be located on the same plane.

The second blocking member 200 includes a second outer circumferential surface 200*b* in contact with an outer circumferential surface of the frame 110 and a second inner circumferential surface 200*a* in contact with the first sealing member 127. Although a state in which the second outer circumferential surface 200*b* and the outer circumferential surface of the frame 110 are arranged on the same plane in an axial direction is illustrated in FIGS. 5 and 7, this state is merely illustrative. For example, the second outer circumferential surface 200*b* may protrude radially outward from the outer circumferential surface of the frame 110.

In this way, the second blocking member 200 is seated on the front surface of the frame 110. Accordingly, the second blocking member 200 may prevent the heat of the refrigerant flowing to the discharge cover 160 from being transferred to the frame 110.

In some implementations, the second blocking member 200 includes first fastening hole communicating ports 204, second fastening hole communicating ports 202, and terminal communicating ports 201, which communicate with the first fastening holes 119*a*, the second fastening holes 119*b*, and the terminal inserting parts 119*c*, respectively. The first fastening hole communicating ports 204, the second fastening hole communicating ports 202, and the terminal communicating ports 201 correspond to each other in terms of the sizes, the shapes, and the numbers of the first fastening holes 119*a*, the second fastening holes 119*b*, and the terminal inserting parts 119*c*.

In detail, the first fastening hole communicating ports 204 are arranged at positions corresponding to the first fastening holes 119*a*, respectively. The cover fastening members 149*a* are inserted into the first fastening holes 119*a* and the first fastening hole communicating ports 204, so that the stator cover 149 and the frame 110 may be coupled to each other. At this time, the cover fastening members 149*a* may not extend to the first fastening hole communicating ports 204 according to a design or due to a process error.

The second fastening hole communicating ports 202 are arranged at positions corresponding to the second fastening holes 119*b*, respectively. Predetermined fastening members configured to fasten the discharge cover 160 and the frame 110 may be coupled to the second fastening holes 119*b* and the second fastening hole communicating ports 202. In detail, the fastening members are coupled by sequentially passing through the discharge cover 160, the second fastening hole communicating ports 202, and the second fastening holes 119*b*.

The terminal communicating ports 201 are arranged at positions corresponding to the terminal inserting parts 119*c*, respectively. The terminal 141*d* is inserted into the terminal communicating port 201 and the terminal inserting part 119*c*. In detail, the terminal 141*d* may extend forward from the coil 141*c* and may be inserted into the terminal communicating port 201 and the terminal inserting part 119*c*.

In some implementations, the second blocking member 200 may be formed to have the same thickness as that of the first blocking member 210. In some examples, the front surface of the second blocking member 200 and the front surface of the first blocking member 210 are located on the same plane.

For example, as illustrated in FIG. 5, when the blocking members 200 and 210 are mounted, a front surface, which includes the blocking members 200 and 210 and the front cylinder part 121*a*, may be flat. Accordingly, the discharge cover 160 may come into close contact with and be coupled to the front surface.

The blocking members 200 and 210 may be formed of a material having small thermal conductivity. The blocking members 200 and 210 include non-asbestos gasket and plastic. This fact is illustrative, and the blocking members 200 and 210 may be formed of various materials having small thermal conductivity or a heat-shielded material.

For example, when the blocking members 200 and 210 are formed of a non-asbestos gasket (hereinafter, referred to as a gasket), the suction temperature may be reduced by 3-4 degrees even with the thickness of about 0.5 mm. Accordingly, the specific volume of the refrigerant introduced into the compressor is reduced, and compression efficiency is improved.

Figure 8:
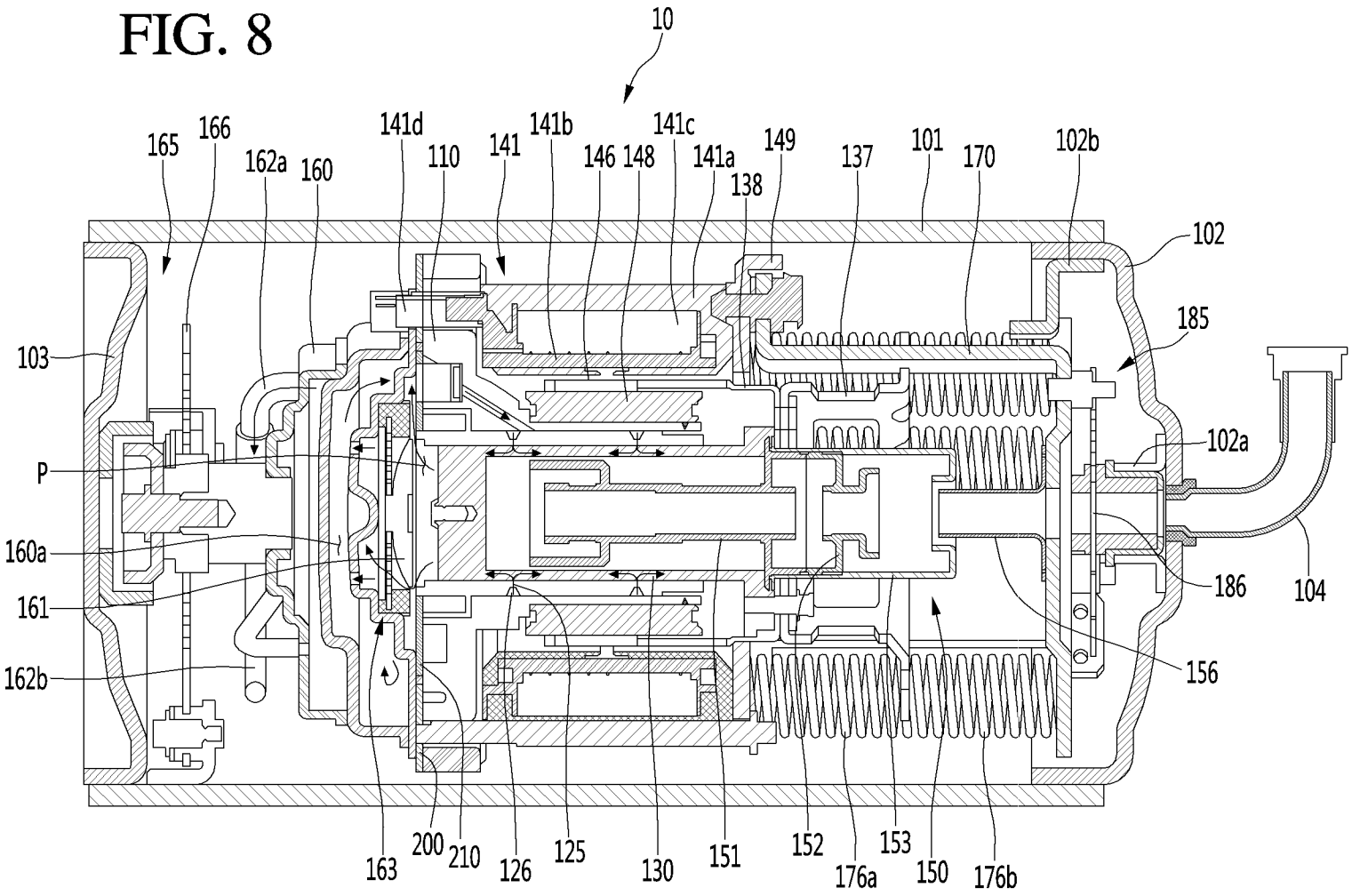
FIG. 8 is a sectional view illustrating example flow of refrigerant inside of the linear compressor.

FIG. 8 is a sectional view illustrating a state in which a refrigerant flows inside the linear compressor.

Referring to FIG. 8, flow of the refrigerant in the linear compressor 10 will be described. The refrigerant suctioned into the shell 101 through the suction pipe 104 is introduced into the piston 130 via the suction muffler 150. At this time, the piston 130 reciprocates in an axial direction by driving of the motor assembly 140.

When the suction valve 135 coupled to a front portion of the piston 130 is opened, the refrigerant is introduced into the compression space P and is compressed. In some implementations, when the discharge valve 161 is opened, the compressed refrigerant is discharged from the compression space P.

A portion of the refrigerant among the discharged refrigerant flows to the frame space 115*d* of the frame 110. In some implementations, most of the other refrigerant passes through the discharge space 160*a* of the discharge cover 160, and is discharged through the discharge pipe 105 via the cover pipe 162*a* and the loop pipe 162*b*.

At this time, the portion of the refrigerant flowing to the frame space 115*d* of the frame 110 may flow to the frame space 115*d* through the gas hole communicating port 211 by the first blocking member 210. That is, a very small amount of the refrigerant flows to the frame space 115*d*, is introduced into the gas hole 114, is supplied between the inner circumferential surface of the cylinder 120 and the outer circumferential surface of the piston 130, and functions as a gas bearing.

For example, the portion of the refrigerant flowing to the frame space 115*d* of the frame 110 does not flow to the deformation space 122*e* due to the first blocking member 210, so that the cylinder 120 is prevented from being deformed.

In some implementations, the heat of the refrigerant flowing to the discharge cover 160 may be prevented from being transferred to the cylinder 120 and the frame 110 due to the first blocking member 210 and the second blocking member 200.

In some examples, heat of the high-temperature discharge refrigerant may be prevented from being transferred to the cylinder 120 and the frame 110, so that the temperature of the suction refrigerant may be relatively reduced. Consequentially, efficiency of the compressor increases.

Although implementations have been described with reference to a number of illustrative implementations thereof, it should be understood that numerous other modifications and implementations can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A linear compressor comprising:

a cylinder that defines a compression space configured to receive refrigerant;

a piston that is located in the cylinder and that is configured to move in an axial direction of the cylinder and to compress refrigerant in the cylinder;

a discharge cover that defines a discharge space configured to receive refrigerant discharged from the compression space;

a frame configured to accommodate the cylinder and coupled to the discharge cover at a front side of the frame;

a first sealing member located between the frame and the discharge cover; and a plurality of blocking members that are located between the discharge cover and at least one of the frame or the cylinder, the plurality of blocking members comprising a first blocking member arranged inside of the first sealing member in a radial direction of the first sealing member, and a second blocking member arranged outside of the first sealing member in the radial direction of the first sealing member, wherein the plurality of blocking members are configured to restrict heat transfer to at least one of the frame or the cylinder from refrigerant discharged from the compression space.

2. The linear compressor of claim 1, wherein each blocking member has a plate shape that covers an end of the frame or an end of the cylinder.

3. The linear compressor of claim 2, wherein the first blocking member has a first inner circumferential surface that contacts the cylinder, and a first outer circumferential surface that contacts the first sealing member, and wherein the second blocking member has a second inner circumferential surface that contacts the first sealing member, and a second outer circumferential surface that extends to an outer circumferential surface of the frame.

4. The linear compressor of claim 3, wherein the frame defines a gas passage configured to guide refrigerant toward an inner circumferential surface of the cylinder to form a gas bearing configured to reduce friction between the cylinder and the piston, and wherein the first blocking member defines a gas hole communicating port that allows a portion of refrigerant discharged from the compression space to flow to the gas passage.

5. The linear compressor of claim 3, wherein the frame defines a fastening hole configured to receive a fastening member that is configured to couple the discharge cover to the frame, and wherein the second blocking member defines a fastening hole communicating port that communicates with the fastening hole of the frame and that allows the fastening member to pass through the second blocking member toward the fastening hole.

6. The linear compressor of claim 2, wherein the first sealing member has a ring shape, and wherein an outer diameter of the first sealing member is greater than an outer diameter of the first blocking member, and less than an outer diameter of the second blocking member.

7. The linear compressor of claim 1, wherein the cylinder comprises a cylinder body configured to accommodate the piston, and a cylinder flange located at an outer side of a front portion of the cylinder body, wherein the frame comprises a frame body configured to accommodate the cylinder body, and a frame flange that extends radially outward from a front portion of the frame body, and wherein the first blocking member contacts an end of the cylinder flange, and the second blocking member contacts an end of the frame flange.

8. The linear compressor of claim 7, wherein the plurality of blocking members extend in a radial direction of the cylinder body from an inner circumferential surface of the cylinder body toward an outer circumferential surface of the frame flange.

9. The linear compressor of claim 7, wherein the cylinder flange comprises:

a first flange that extends from an outer circumferential surface of the cylinder body in a radial direction of the cylinder body; and a second flange that extends from the first flange in an axial direction of the cylinder body, and wherein the cylinder body comprises a front cylinder part that extends in the axial direction of the cylinder body from an end of the cylinder body toward an end of the first flange.

10. The linear compressor of claim 9, wherein the cylinder defines a deformation space by the front cylinder part, the first flange, and the second flange, and wherein the first blocking member is configured to cover a front side of the deformation space to restrict refrigerant from flowing into the deformation space.

11. The linear compressor of claim 9, further comprising a second sealing member located at a side of the first flange opposite of the front cylinder part and configured to increase coupling force between the frame and the cylinder.

12. The linear compressor of claim 11, wherein the frame defines a recess configured to receive the second sealing member.

13. The linear compressor of claim 1, wherein the plurality of blocking members comprise a material that has a thermal conductivity less than a thermal conductivity of the cylinder and a thermal conductivity of the frame.

14. The linear compressor of claim 13, wherein the plurality of blocking members comprise at least one of a non-asbestos gasket, a plastic material, or a heat-insulation material.

15. A linear compressor comprising:

a cylinder that defines a compression space configured to receive refrigerant;

a piston that is located in the cylinder and that is configured to move in an axial direction of the cylinder and to compress refrigerant in the cylinder;

a discharge cover that defines a discharge space configured to receive refrigerant discharged from the compression space;

a frame that accommodates the cylinder, that is coupled to the discharge cover at a front side of the frame, and that defines a gas passage configured to guide refrigerant toward the cylinder to form a gas bearing that reduces friction between the cylinder and the piston;

a first blocking member that is located at an axial end of the cylinder, that is configured to restrict heat transfer to the cylinder from refrigerant discharged from the compression space, and that defines a gas hole communicating port that allows a portion of refrigerant discharged from the compression space to flow to the gas passage; and a second blocking member that is arranged outside of the first blocking member in a radial direction of the cylinder, that is located at an axial end of the frame, and that is configured to restrict heat transfer to the frame from refrigerant discharged from the compression space, wherein the discharge cover is configured to cover the gas hole communicating port and is coupled to the second blocking member and to the axial end of the frame.

16. The linear compressor of claim 15, wherein the first and second blocking members have planar ring shapes that cover the axial end of the frame and the axial end of the cylinder, respectively.

17. The linear compressor of claim 16, further comprising a sealing member that has a ring shape and that is located between the first blocking member and the second blocking member in the radial direction.

18. The linear compressor of claim 17, wherein an outer diameter of the sealing member is greater than an outer diameter of the first blocking member, and less than an outer diameter of the second blocking member.

19. The linear compressor of claim 15, wherein the cylinder comprises a cylinder body configured to accommodate the piston, and a cylinder flange located at an outer side of a front portion of the cylinder body, wherein the frame comprises a frame body configured to accommodate the cylinder body, and a frame flange that extends radially outward from a front portion of the frame body, and wherein the first blocking member contacts an end of the cylinder flange, and the first second blocking member contacts an end of the frame flange.

* * * * *